US011761743B2

(12) United States Patent
McNelis et al.

(10) Patent No.: US 11,761,743 B2
(45) Date of Patent: Sep. 19, 2023

(54) LOW VOLTAGE PRIMARY FREE DETONATOR

(71) Applicant: DynaEnergetics Europe GmbH, Troisdorf (DE)

(72) Inventors: Liam McNelis, Bonn (DE); Joerg Bergmann, Eitorf (DE)

(73) Assignee: DynaEnergetics Europe GmbH, Troisdorf (DE)

( * ) Notice: Subject to any disclaimer, the term of this patent is extended or adjusted under 35 U.S.C. 154(b) by 0 days.

(21) Appl. No.: 17/926,178

(22) PCT Filed: May 19, 2021

(86) PCT No.: PCT/EP2021/063339
§ 371 (c)(1),
(2) Date: Nov. 18, 2022

(87) PCT Pub. No.: WO2021/234025
PCT Pub. Date: Nov. 25, 2021

(65) Prior Publication Data

US 2023/0194229 A1 Jun. 22, 2023

Related U.S. Application Data

(60) Provisional application No. 63/027,591, filed on May 20, 2020.

(51) Int. Cl.
*F42C 19/08* (2006.01)
*F42C 19/12* (2006.01)
*F42B 3/10* (2006.01)

(52) U.S. Cl.
CPC ..... *F42C 19/0807* (2013.01); *F42B 3/10* (2013.01); *F42C 19/08* (2013.01); *F42C 19/0803* (2013.01); *F42C 19/12* (2013.01)

(58) Field of Classification Search
CPC ..... F42B 1/04; F42B 3/04; F42B 3/10; F42C 19/08; F42C 19/0803; F42C 19/0807; F42C 19/12; C06C 5/04; C06C 5/06; C06C 7/00
See application file for complete search history.

(56) References Cited

U.S. PATENT DOCUMENTS 4,144,814 A * 3/1979 Day ..... F42C 19/0807 102/202.13
4,316,412 A 2/1982 Dinegar et al.
(Continued)

FOREIGN PATENT DOCUMENTS

CA 1295185 C 2/1992
CA 2252353 A1 5/2000
(Continued)

OTHER PUBLICATIONS

Forcit, Firex Electric Detonator, Jun. 6, 2011, 18 pgs., https://forcitgroup.com/.
(Continued)

*Primary Examiner* — James S Bergin
(74) *Attorney, Agent, or Firm* — Womble Bond Dickinson (US) LLP

(57) ABSTRACT

Embodiments of a low-voltage, non-primary explosive detonator (110) may include a detonator shell (120) having an open end (122), a closed end (124), and a hollow interior (125) between the open and closed ends. Some embodiments include a reinforcement area of the detonator shell. A pyrotechnical material is disposed within the hollow interior, and a main explosive load is disposed within the hollow interior in between the pyrotechnical material and the closed end. In some embodiments, one or both of the pyrotechnical material and the main explosive load may be multilayered, for example with a density gradient configured to accelerate deflagration. The detonator may further include a fuse head
(Continued)

SHELL WITH VENTURI SHAPE INLET disposed at the open end and in proximity to the pyrotechnical material within the detonator shell.

20 Claims, 16 Drawing Sheets

(56) References Cited

U.S. PATENT DOCUMENTS

| | | | | |
|---|---|---|---|---|
| 4,317,413 | A * | 3/1982 | Strandli | F42C 19/0807 102/275.9 |
| 4,727,808 | A | 3/1988 | Wang et al. | |
| 4,858,529 | A * | 8/1989 | Lieberman | C06C 7/00 102/202.5 |
| 5,385,098 | A | 1/1995 | Lindqvist et al. | |
| 5,945,627 | A | 8/1999 | Arpin et al. | |
| 6,227,116 | B1 | 5/2001 | Dumenko | |
| 6,408,759 | B1 | 6/2002 | Ewick et al. | |
| 6,880,465 | B2 | 4/2005 | Badger et al. | |
| 7,051,655 | B1 | 5/2006 | Moulard et al. | |
| 7,546,805 | B2 | 6/2009 | Voreck et al. | |
| 8,051,775 | B2 * | 11/2011 | Henderson | F42B 3/00 102/275.6 |
| 8,161,880 | B2 | 4/2012 | Wuensche et al. | |
| 8,286,555 | B2 * | 10/2012 | Wuensche | F42D 1/04 102/275.9 |
| 8,291,826 | B2 * | 10/2012 | Wuensche | C06C 7/00 102/275.9 |
| 10,151,569 | B2 * | 12/2018 | Glenn | F42B 3/10 |
| 2013/0042780 | A1 | 2/2013 | Brooks et al. | |
| 2016/0003600 | A1 | 1/2016 | Glenn et al. | |

FOREIGN PATENT DOCUMENTS

| | | | |
|---|---|---|---|
| CA | 2252353 | C | 6/2007 |
| CN | 2562163 | | 7/2003 |
| CN | 202793187 | U | 3/2013 |
| CN | 103673795 | A | 3/2014 |
| CN | 104897011 | B | 8/2016 |
| DE | 10308444 | A1 | 12/2005 |
| DE | 102005031673 | A1 | 3/2006 |
| EP | 3869935 | B1 | 3/2001 |
| GB | 2176178 | A | 12/1986 |
| JP | 1729947 | B2 | 7/2011 |
| RU | 2156945 | C1 | 9/2000 |
| WO | 1986001498 | A1 | 3/1986 |
| WO | 2021234025 | A1 | 11/2021 |

OTHER PUBLICATIONS

Hunting Titan, Control Fire EFI Cartridge, Sep. 18, 2020, 2 pgs., www.hunting-intl.com/titan.

International Searching Authority; International Search Repod and Written Opinion of the International Searching Authority for PCT/EP2021/063339; dated Sep. 23, 2021; 19 pages.

Massis et al., New Explosive Materials and Pyrotechnic Formulations with Improved Safety and Sensitivity Properties, Aug. 1996, 13 pgs., www.dtic.mil/dtic/tr/fulltext/u2/a514103.pdf.

Panicker et al., Experimental Investigations on DDT Enhancements by Shchelkins Spirals in a PDE, Aerodynamic Research Center, The University of Texas at Arlington, Mechanical & Aerospace Engineering, Mar. 9, 2007, 27 pgs.

* cited by examiner

LOW VOLTAGE PRIMARY FREE DETONATOR

CROSS-REFERENCE TO RELATED APPLICATIONS

This application is a national stage entry of International PCT Patent Application PCT/EP2021/063339 filed May 19, 2021, which claims the benefit of U.S. Provisional Patent Application 63/027,591 filed May 20, 2020, all of which are herein incorporated by reference in their entirety.

BACKGROUND OF THE DISCLOSURE

Hydrocarbons, such as fossil fuels (e.g. oil) and natural gas, are extracted from underground wellbores extending deeply below the surface using complex machinery and explosive devices. Once the wellbore is established by placement of casing pipes after drilling and cementing the casing pipe in place, a perforating gun assembly, or train or string of multiple perforating gun assemblies, are lowered into the wellbore, and positioned adjacent one or more hydrocarbon reservoirs in underground formations.

Assembly of a perforating gun may require assembly of multiple parts. Such parts typically include a housing or outer gun barrel containing or connected to perforating gun internal components such as: an electrical wire for relaying an electrical control signal such as a detonation signal from the surface to electrical components of the perforating gun; an electrical, mechanical, and/or explosive initiator such as a percussion initiator, an igniter, and/or a detonator; a detonating cord; one or more explosive and/or ballistic charges which are held in an inner tube, strip, or other carrying device; and other known components including, for example, a booster, a sealing element, a positioning and/or retaining structure, a circuit board, and the like. The internal components may require assembly including connecting electrical components within the housing and confirming and maintaining the connections and relationships between internal components. The assembly procedure may be difficult within the relatively small free space within the housing. Typical connections may include connecting the electrical relay wire to the detonator or the circuit board, coupling the detonator and the detonating cord and/or the booster, and positioning the detonating cord in a retainer at an initiation point of each charge.

The housing may also be connected at each end to a respective adjacent wellbore tool or other component of the tool string such as a firing head and/or a tandem seal adapter or other sub assembly. Connecting the housing to the adjacent component(s) typically includes screwing the housing and the adjacent component(s) together via complementary threaded portions of the housing and the adjacent components and forming a connection and seal therebetween.

Known perforating guns may further include explosive charges, typically shaped, hollow, or projectile charges, which are initiated, e.g., by the detonating cord, to perforate holes in the casing and to blast through the formation so that the hydrocarbons can flow through the casing. In other operations, the charges may be used for penetrating just the casing, e.g., during abandonment operations that require pumping concrete into the space between the wellbore and the wellbore casing, destroying connections between components, severing a component, and the like. The exemplary embodiments in this disclosure may be applicable to any operation consistent with this disclosure. For purposes of this disclosure, the term "charge" and the phrase "shaped charge" may be used interchangeably and without limitation to a particular type of explosive, charge, or wellbore operation, unless expressly indicated.

The perforation guns may be utilized in initial fracturing process or in a refracturing process. Refracturing serves to revive a previously abandoned well in order to optimize the oil and gas reserves that can be obtained from the well. In refracturing processes, a smaller diameter casing is installed and cemented in the previously perforated and accessed well. The perforating guns must fit within the interior diameter of the smaller diameter casing, and the shaped charges installed in the perforating guns must also perforate through double layers of casing and cement combinations in order to access oil and gas reserves.

The explosive charges may be arranged and secured within the housing by the carrying device which may be, e.g., a typical hollow charge carrier or other holding device that receives and/or engages the shaped charge and maintains an orientation thereof. Typically, the charges may be arranged in different phasing, such as 60°, 120°, 180°, etc. along the length of the charge carrier, so as to form, e.g., a helical pattern along the length of the charge carrier. Charge phasing generally refers to the radial distribution of charges throughout the perforating gun, or, in other words, the angular offset between respective radii along which successive charges in a charge string extend in a direction away from an axis of the charge string. An explosive end of each charge points outwardly along a corresponding radius to fire an explosive jet through the gun housing and wellbore casing, and/or into the surrounding rock formation. Phasing the charges therefore generates explosive jets in a number of different directions and patterns that may be variously desirable for particular applications. On the other hand, it may be beneficial to have each charge fire in the same radial direction. A charge string in which each charge fires in the same radial direction would have zero-degree (0°) phasing.

Once the perforating gun(s) is properly positioned, a surface signal actuates an ignition of a fuse or detonator, which in turn initiates the detonating cord, which detonates the explosive charges to penetrate/perforate the housing and wellbore casing, and/or the surrounding rock formation to allow formation fluids to flow through the perforations thus formed and into a production string.

Most electrically activated detonators employ primary explosives, inside the detonator shell, due to the material's excellent DDT (Deflagration to Detonation Transfer) characteristics. Primary Explosives such as lead azide or silver azide have the capability to transfer from a burn/ignition, i.e., deflagration, to a high-speed detonation within a few millimeters of compressed material thickness. Deflagration (i.e., "to burn down") is subsonic combustion propagating through heat transfer; hot burning material heats the next layer of cold material and ignites it. Detonation, in contrast, is propagation of combustion by the explosive shock wave travelling through or into the explosive material.

Typically, a primary explosive would be a highly sensitive explosive material with friction sensitivity, impact sensitivity, and/or sensitivity to electrostatic discharge which is more sensitive than that of PETN (Nitro-Penta). Primary explosives are extremely sensitive to friction and impact energy, as well as being very sensitive to electrostatic discharge. In order to minimize the risk of an unintentional initiation, there is often a desire or technical requirement to use detonators which do not contain any primary explosives. Most detonators without any primary explosives require a very high voltage (kV) or current level (Amps) in order to initiate the less sensitive secondary explosive (e.g. main explosive load) directly from a filament wire or initiating foil by inducing enough energy (e.g. heat) directly to the secondary explosive to cause it to detonate instantaneously.

Typical high voltage primary-free initiators or detonators which currently exist, include EFI's (Exploding Foil Initiators), EBW's (Exploding Bridge Wires) or SCB Initiators (Semiconductor Bridge Initiators). Other typical primary-free detonators use granulated material, different particles sizes and/or shapes, or crystalline material, in the detonator design, in order to achieve initiation sensitivity and also the transformation from a deflagration to detonation, without using primary explosives.

Accordingly, there is a need for a primary-free detonator that provides for a reliable deflagration to detonation process. There is a further need for a primary-free detonator that is capable of combustion or deflagration and then detonation when utilizing conventional secondary explosives. Additional needs may include detonators which do not require high voltage and/or current to initiate.

BRIEF DESCRIPTION OF THE EXEMPLARY EMBODIMENTS

Embodiments of the disclosure are associated with a low-voltage, non-primary (e.g. primary-free) explosive detonator. The detonator includes a detonator shell having an open end, a closed end, and a hollow interior (e.g. cavity) extending between the open end and the closed end. A pyrotechnical material and a multilayered main explosive load may be disposed within the hollow interior of the detonator shell, with the multilayered main explosive load located between the pyrotechnical material and the closed end. In some embodiments, the detonator shell may include a reinforcement area extending along at least a portion of the hollow interior. The reinforcement area may be configured to reinforce the detonator shell, for example so that the detonator shell and reinforcement area together are mechanically robust enough to confine combustion of the pyrotechnical material without mechanical failure. Typically, the pyrotechnical material may be at least partially disposed within the reinforcement area.

In another aspect, exemplary embodiments include a detonator that is a low-voltage, primary-free detonator, which includes a ballistic vessel, a pyrotechnical material, and a multilayered main explosive load. The ballistic vessel may include a detonator shell having an open end, a closed end, a hollow interior extending between the open end and the closed end, and a deflagration to detonation transition (DDT) section extending along at least a portion of the hollow interior. In some embodiments, the DDT section may comprise a reinforcement area extending from an inner surface of the detonator shell towards the hollow interior. The pyrotechnical material in such embodiments may be disposed within the DDT section, and the multilayered main explosive load may be disposed within the hollow interior of the detonator shell between the pyrotechnical material and the closed end.

In yet another aspect, exemplary embodiments include a perforating gun assembly, including a detonator configured substantially as described herein. In some embodiments, the detonator may be a low-voltage, primary-free detonator, configured substantially as described herein.

BRIEF DESCRIPTION OF THE DRAWINGS

A more particular description will be rendered by reference to exemplary embodiments that are illustrated in the accompanying figures. Understanding that these drawings depict exemplary embodiments and do not limit the scope of this disclosure, the exemplary embodiments will be described and explained with additional specificity and detail through the use of the accompanying drawings in which.

Figure 1A:
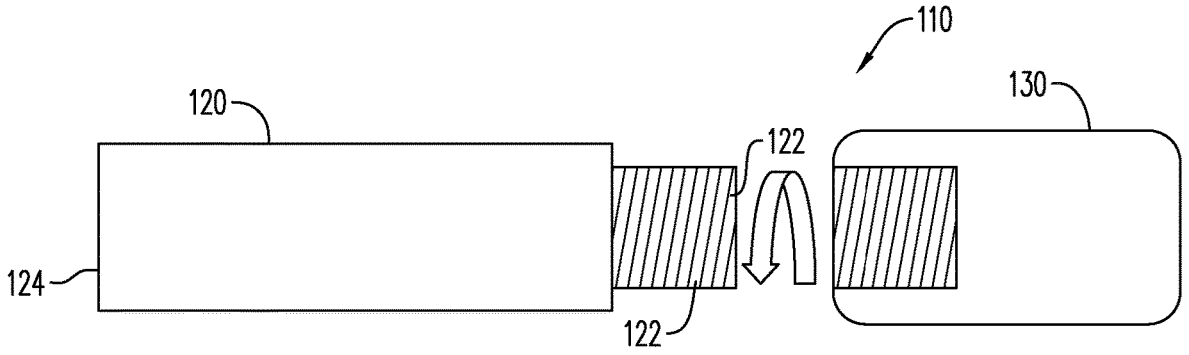
FIG. 1A is a plan view of components of a detonator, according to an embodiment.
Figure 1B:
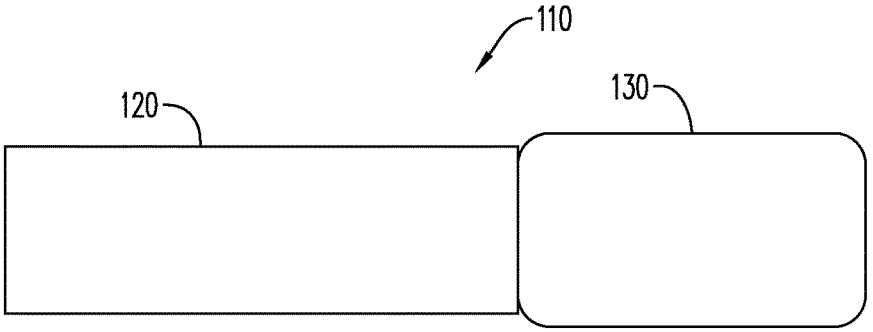
FIG. 1B is a plan view of the detonator of FIG. 1A as assembled, with the plug attached to the detonator shell, according to an embodiment.
Figure 1C:
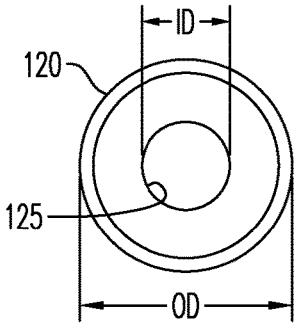
FIG. 1C is a side view of the detonator shell of FIG. 1A, illustrating the hollow interior, according to an embodiment.

Various features, aspects, and advantages of the exemplary embodiments will become more apparent from the following detailed description, along with the accompanying drawings in which like numerals represent like components throughout the figures and detailed description. The various described features are not necessarily drawn to scale in the drawings but are drawn to emphasize specific features relevant to some embodiments.

The headings used herein are for organizational purposes only and are not meant to limit the scope of the disclosure or the claims. To facilitate understanding, reference numerals have been used, where possible, to designate like elements common to the figures.

DETAILED DESCRIPTION

Reference will now be made in detail to various embodiments. Each example is provided by way of explanation and is not meant as a limitation and does not constitute a definition of all possible embodiments.

As used herein the term "deflagration" references to burn down, and is a subsonic combustion propagating through heat transfer whereby hot burning material heats the next layer of cold material and ignites it.

Embodiments described herein relate generally to a primary-free detonator for use in perforating gun assemblies. For purposes of this disclosure, the phrases "devices," "systems," and "methods" may be used either individually or in any combination referring without limitation to disclosed components, grouping, arrangements, steps, functions, or processes.

For purposes of illustrating features of the embodiments, an exemplary embodiment will now be introduced and referenced throughout the disclosure. This example is illustrative and not limiting and is provided for illustrating the exemplary features of a primary-free detonator and a perforating gun assembly including a primary-free detonator as described throughout this disclosure.

FIGS. 1A-3B illustrate exemplary embodiments of a detonator 110. The detonator 110 includes a detonator shell 120 (which also may be termed a blasting cap, a main body, or a ballistic vessel in some embodiments) having an open end 122, a closed end 124, and a hollow interior 125 (e.g. a cavity) extending between the open end 122 and the closed end 124. Typically, the detonator shell 120 may be substantially cylindrical and formed of one piece of machined or pre-forged metal, such as steel. The dimensions of the detonator shell 120 (e.g. length, width and wall thickness) may be selected to provide sufficient real estate for an electronics board and other components of the detonator 110, and to provide a robust structure that will be able to withstand the pressure build up inside the detonator shell 120 during the deflagration to detonation process. In some embodiments, the detonator shell 120 may includes at least one of an outer diameter of 8 mm to 20 mm, an inner diameter of at least 7 mm, a wall thickness of at least 4.5 mm, and a length of up to 70 mm. According to an aspect, the outer diameter is at least 16 mm. The length of the detonator shell 120 may be less than 60 mm.

Figure 2:
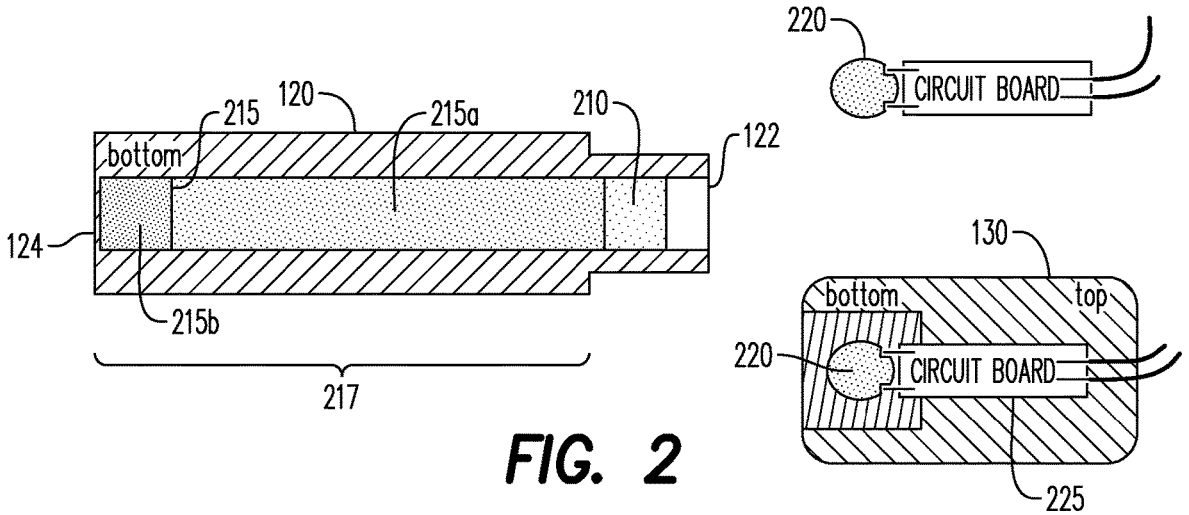
FIG. 2 is a cross-section view of the plug and detonator components of an unassembled detonator, according to an embodiment.

In some embodiments, a pyrotechnical material 210 and a main explosive load 215 may be disposed within the hollow interior 125 of the detonator shell 120 (see for example, FIG. 2). The detonator shell 120 may be configured to confine a burning gas within the volume of the shell 120, so that the deflagration or burn speed increases or accelerates linearly until it reaches a detonation velocity of >6000 m/sec. This type of detonation velocity can then be capable of reliably initiating the main explosive load 215 (e.g. without the need for primary explosive).

In some embodiments, at least one of the pyrotechnical material 210 and the main explosive load 215 is multilayered. For example, and as illustrated in at least FIG. 2, the main explosive load 215 is a multilayered main explosive load 217 (e.g. includes two or more layers of main explosive load 215). The multilayered main explosive load 217 includes a first layer 215*a* and a second layer 215*b*. In some embodiments, the main explosive load 215 or multilayered main explosive load 217 may be disposed within the hollow interior 125 of the detonator shell 120 between the pyrotechnical material 210 and the closed end 124. For example, in FIG. 2, both layers of the multilayered main explosive load 217 are disposed between the pyrotechnical material 210 and the closed end 124, and the pyrotechnical material 210 is disposed between the main explosive load 215 (e.g. both layers of the multilayered main explosive load 217) and the open end 122. In disclosed embodiments, the detonator 110 does not include any primary explosive (such as lead azide or silver azide). For example, the pyrotechnical material 210 in FIG. 2 is not a primary explosive.

Figure 3A:
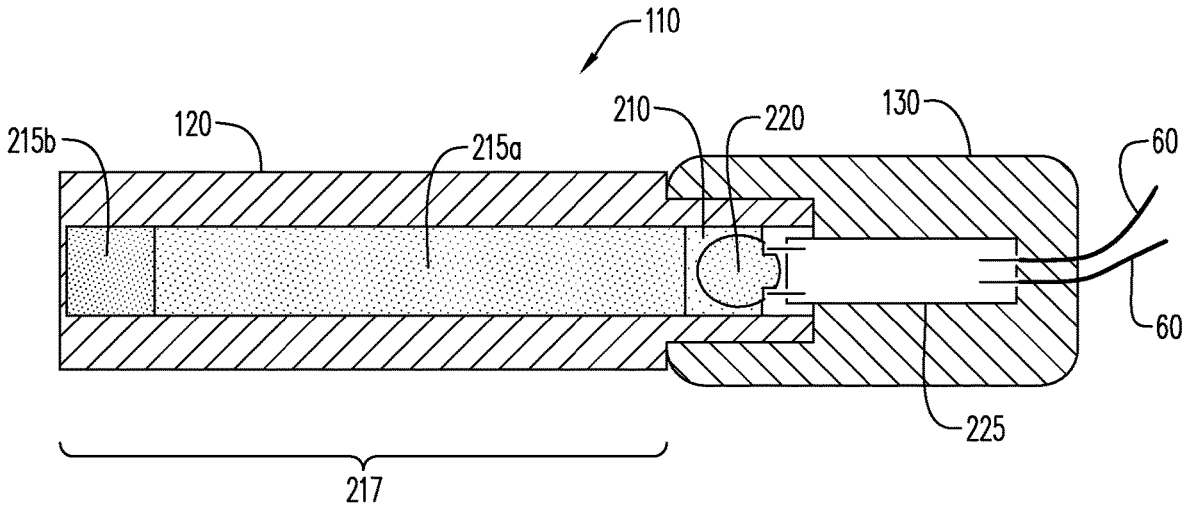
FIG. 3A is a cross-section view of the plug and detonator components of an assembled detonator, according to an embodiment.
Figure 3B:
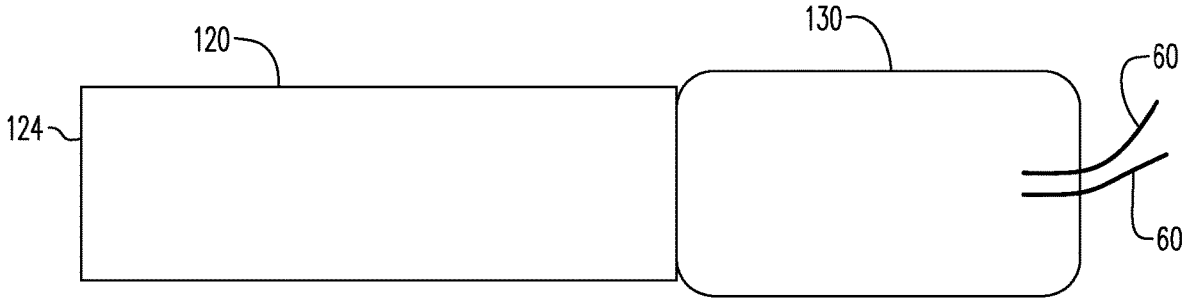
FIG. 3B is a plan view is an assembled detonator, according to an embodiment.
Figure 4:
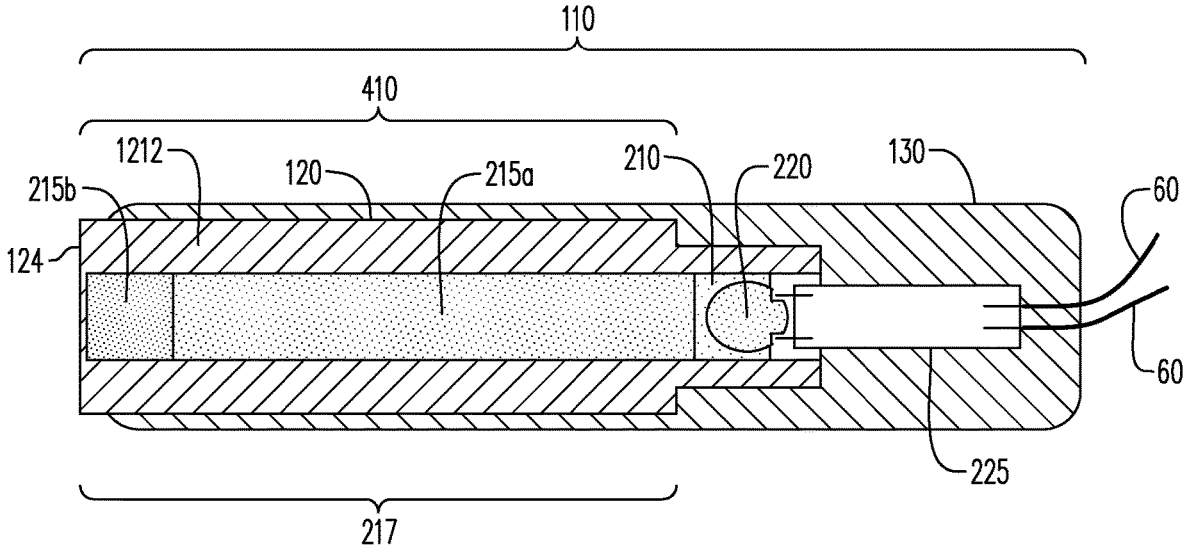
FIG. 4 is a cross-sectional view of a detonator, according to an embodiment.

As shown in FIGS. 1A-3B, a plug 130 may be configured to close the open end 122 of the detonator shell 120. The plug 130 (which may be cylindrical) may include an internal thread 121*a* that secures to corresponding external threads 121*b* at the open end 122 of the detonator shell 120. As shown in FIGS. 2-4, some embodiments may further include a fuse head 220 disposed in proximity to the open end 122 of the detonator shell 120 and at least partially extending into the hollow interior 125. For example, the fuse head 220 may be disposed within the plug 130. The fuse head 220 may be configured to initiate combustion of the pyrotechnical material 210. In some embodiments, the fuse head 220 may be disposed in proximity to the pyrotechnical material 210, and the pyrotechnical material 210 may be disposed between the fuse head 220 (or open end 122) and the multilayered main explosive load 217. In some embodiments, the fuse head 220 may include a bridge wire or filament coated in a reactive high-energy pyrotechnical composition. In some embodiments, the fuse head 220 does not require a high voltage impulse (e.g. less than 30 volts) and/or a large current (e.g. less than 800 mA) to detonate the pyrotechnical material 210. In some embodiments, the fuse head 220 may be configured to be initiated using an RF-Safe digital code sequence through a circuit board 225. The plug 130 may include one or more electrical contacts. For example, the electrical contacts may be electrically coupled to the fuse head 220 (for example, via the circuit board 225). In some embodiments, the electrical contacts may each be secured to a leg wire, which may extend along the length of the plug 130. According to an aspect, leg wires 60 extend through the plug. The leg wires 60 are configured to provide electrical connection to the circuit board 225. According to an aspect, the leg wires include a first leg wire, and a second leg wire spaced apart from the first leg wire. The first and second leg wires are both configured to provide electrical connection to the printed circuit board 225.

Figure 5A:
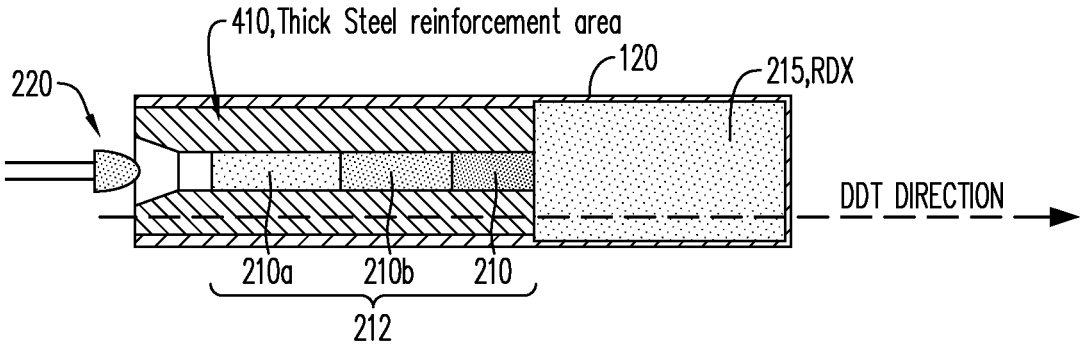
FIGS. 5A-5D are schematic cross-section figures which illustrate various detonator shell designs of a detonator, according to an embodiment.

As shown in FIG. 4, some embodiments of the detonator 110 may further include a reinforcement area 410 extending along at least a portion of the hollow interior 125 and configured to reinforce the detonator shell 120. The reinforcement area 410, for example in conjunction with the detonator shell 120, may be configured to be mechanically robust enough to confine combustion of the pyrotechnical material 210 without splitting open. The reinforcement area 410 may be configured to maintain a pressure build up inside the detonator shell 120 and to prevent the detonator shell 120 from splitting or opening, which could prevent a reliable deflagration to detonation transition process. The pyrotechnical material 210 may be at least partially disposed within the reinforcement area 410, and often the pyrotechnical material 210 is entirely disposed within the reinforcement area 410. In some embodiments, some or all of the main explosive load 215 may also be disposed within the reinforcement area 410, although in other embodiments the main explosive load 215 may not be disposed within the reinforcement area 410 (e.g. as shown in FIG. 5A, with the pyrotechnical material 210 located in the reinforcement area 410, and the main explosive load 215 disposed in a portion of the detonator shell 120 extending beyond the reinforcement area 410). In some embodiments, the reinforcement area 410 may form a deflagration to detonation transition (DDT) section extending along at least a portion of the hollow interior 125.

Figure 5B:
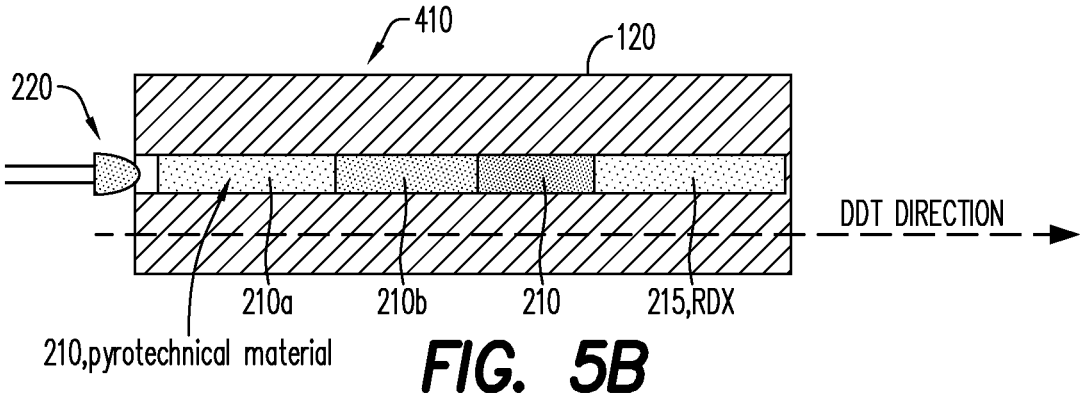
Figure 5C:
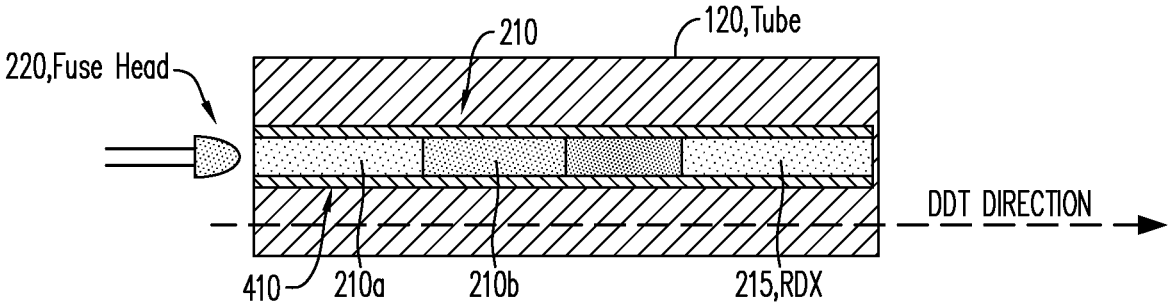
Figure 5D:
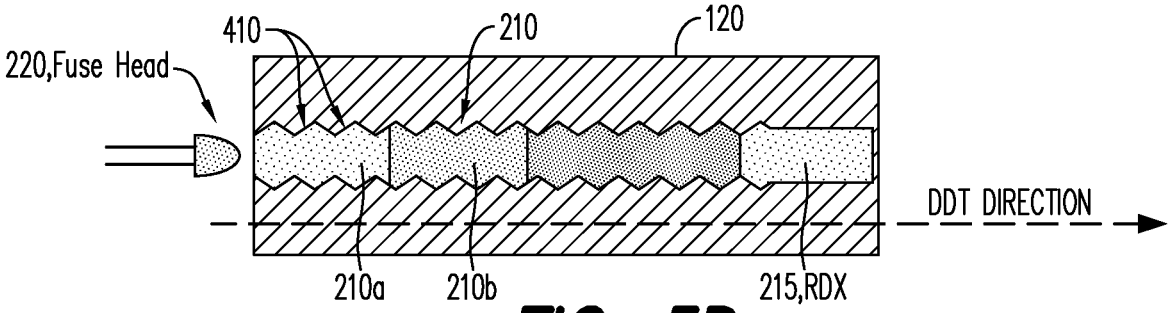

In some embodiments, the reinforcement area 410 may extend from an inner surface of the detonator shell 120 towards the hollow interior 125 and/or may be integral or integrated into the detonator shell 120 (e.g. with a portion of the detonator shell 120 having sufficient thickness to serve as the reinforcement area 410, as shown in FIG. 5A). For example, the reinforcement area 410 may include a portion of the detonator shell 120 with a thickness of at least 4.5 mm. As illustrated in FIG. 5A, a portion of the detonator shell 120 can have a reduced inner diameter area within which the pyrotechnical material 210 is positioned, while the main explosive load 215 can be positioned in another portion of the detonator shell 120 with an increased inner diameter. In some embodiments, the reinforcement area 410 may extend substantially the entire length of the detonator shell 120 (e.g. as shown in FIG. 5B, in which a thick-walled detonator shell 120 serves to form an integral reinforcement area 410). FIG. 5B illustrates an embodiment of the detonator shell 120 having a reduced inner diameter extending along the length of the detonator shell 120 (e.g. forming thicker walls for the detonator shell 120), within which the pyrotechnical material 210 and the main explosive load 215 both can be positioned. In some embodiments, the reinforcement area 410 may include reinforcement material configured to supplement the tensile strength of the detonator shell 120. For example, as shown in FIG. 5C, the reinforcement area 410 may be formed by an inner tube or sleeve disposed within and longitudinally extending for at least a portion of the length of the hollow interior 125 of the detonator shell 120. In the embodiment shown in FIG. 5C, the inner tube extends substantially along the entire length of the detonator shell 120, particularly the area within which the pyrotechnical material 210 and the main explosive load 215 are positioned. FIG. 5D illustrates another exemplary reinforcement area 410 in which the reinforcement area 410 includes one or more ribs or projections circumferentially extending around the inner surface of the detonator shell 120. In some embodiments, an inner surface of the detonator shell 120 may include a helical pattern of projections for the reinforced area. In some embodiments, the reinforcement area 410 may increase turbulence for gas pressure buildup in the detonator shell 120.

The pyrotechnical material 210 of the disclosed embodiments may be a non-primary explosive material operable to deflagrate and detonate with the main explosive load 215. In some embodiments, the pyrotechnical material 210 may be capable of combustion or deflagration and then detonation. For example, the pyrotechnical material 210 may include (conventional, off-the-shelf) black powder or Pyrodex. Typically, the pyrotechnical material 210 may have been tested for friction and impact sensitivity using conventional BAM test methods to confirm that they do not fall into the primary explosives category. The heat energy and pressure produced during the combustion or deflagration process inside the detonator 110 can be increased by using certain additives to the combustible pyrotechnical material 210, such as aluminum or other particles which react exothermically (but in some embodiments, the process may be stable without the use of additives).

The main explosive load 215 of the disclosed embodiments may include conventional, off-the-shelf RDX explosive (e.g., cyclotrimethylenetrinitramine or $(O_2NNCH_2)_3$,) or other, similar main explosive load materials. In some embodiments, the main explosive load 215 is PETN-free.

The detonator assembly does not require a specific grain size or structure of the individual particles. In fact, no sieving or granulation process of either the pyrotechnical material 210 or the main explosive load 215 is necessary (e.g. the pyrotechnical material 210 and/or the main explosive load 215 may be disposed within the detonator shell 120 without sieving or granulation processing, for example each having the same grain or standard grain variations throughout). By changing the pressed density of the pyrotechnical material 210 and/or the main explosive load 215, in multiple layers pressed on top of each other, as well as confining the burning gas-pressure within a detonator shell 120 mechanically robust enough so that it does split open under the combustion process, the deflagration can be transformed into a high-speed detonation within a certain distance in the direction of propagation (e.g. from the open end towards the closed end).

In some embodiments, the multilayered main explosive load 217 may include approximately or substantially the same material throughout, with variations in density. For example, the multilayered main explosive load 217 may be configured so that a lowest density layer is disposed in proximity to the pyrotechnical material 210, and each subsequent layer extending away from the pyrotechnical material 210 (and towards the closed end 124) includes a higher pressed density. In such an example, the density of the multilayered main explosive load 217 would vary from lowest to highest moving from proximity to the pyrotechnical material 210 towards the closed end 124, so that the layer in closest proximity to the pyrotechnical material 210 has the lowest density of the main explosive load 215, and the layer in closest proximity to the closed end 124 (e.g. furthest from the pyrotechnical material 210) has the highest density. In some embodiments, the multilayered main explosive load 217 may have a density gradient formed by the orientation of the layers, which is configured to accelerate deflagration. The density gradient typically may extend from proximity to the pyrotechnical material 210 towards the closed end 124, with each successive layer of the multilayered main explosive load 217 having a greater density than the previous layer (although slight variations, such as adjacent subsequent layers having the same or slightly lower density, may also be acceptable in some embodiments). In some embodiments, the density gradient may be configured so that the density of the first layer 215*a* (e.g. in proximity to the pyrotechnical material 210) may be lower than the density of the last layer (e.g. located furthest from the pyrotechnical material 210) and/or the general trend of the density gradient (for example, if the density of the layers is plotted on a graph and a line approximation of the trend is applied to the graph) is from lower to higher density (e.g. as illustrated in FIGS. 8-11).

For example, and as shown in FIG. 2, the multilayered main explosive load 217 may include a first layer 215*a* comprising a first pressed density, and a second layer 215*b* comprising a second pressed density. The first pressed density may differ from the second pressed density. The first layer 215*a* may be disposed adjacent to and/or contacting the pyrotechnical material 210, and the second layer 215*b* may be disposed between the first layer 215*a* and the closed end 124. In some embodiments, the second pressed density is greater than the first pressed density. In the example of FIG. 2, the first layer 215*a* and the second layer 215*b* are contacting (e.g. pressed into contact). In some embodiments, the density of the layers of the multilayered main explosive load 217 may be configured based on press force, amount of material pressed into the layer, and/or the amount of compression (e.g. the thickness of each layer after compression with the press force).

This pattern may be repeated for additional layers of the multilayered main explosive load 217 in some embodiments having still further layers. For example, the multilayered main explosive load 217 may further include a third layer 215*c* having a third pressed density greater than the second pressed density, with the second layer 215*b* disposed between the first layer 215*a* and the third layer 215*c*. In some embodiments, the multilayered main explosive load 217 may further include a fourth layer 215*d* having a fourth pressed density greater than the third pressed density, with the third layer 215*c* disposed between the second layer 215*b* and the fourth layer 215*d* (and so on for any additional layers of the multilayered main explosive load 217).

Figure 8:
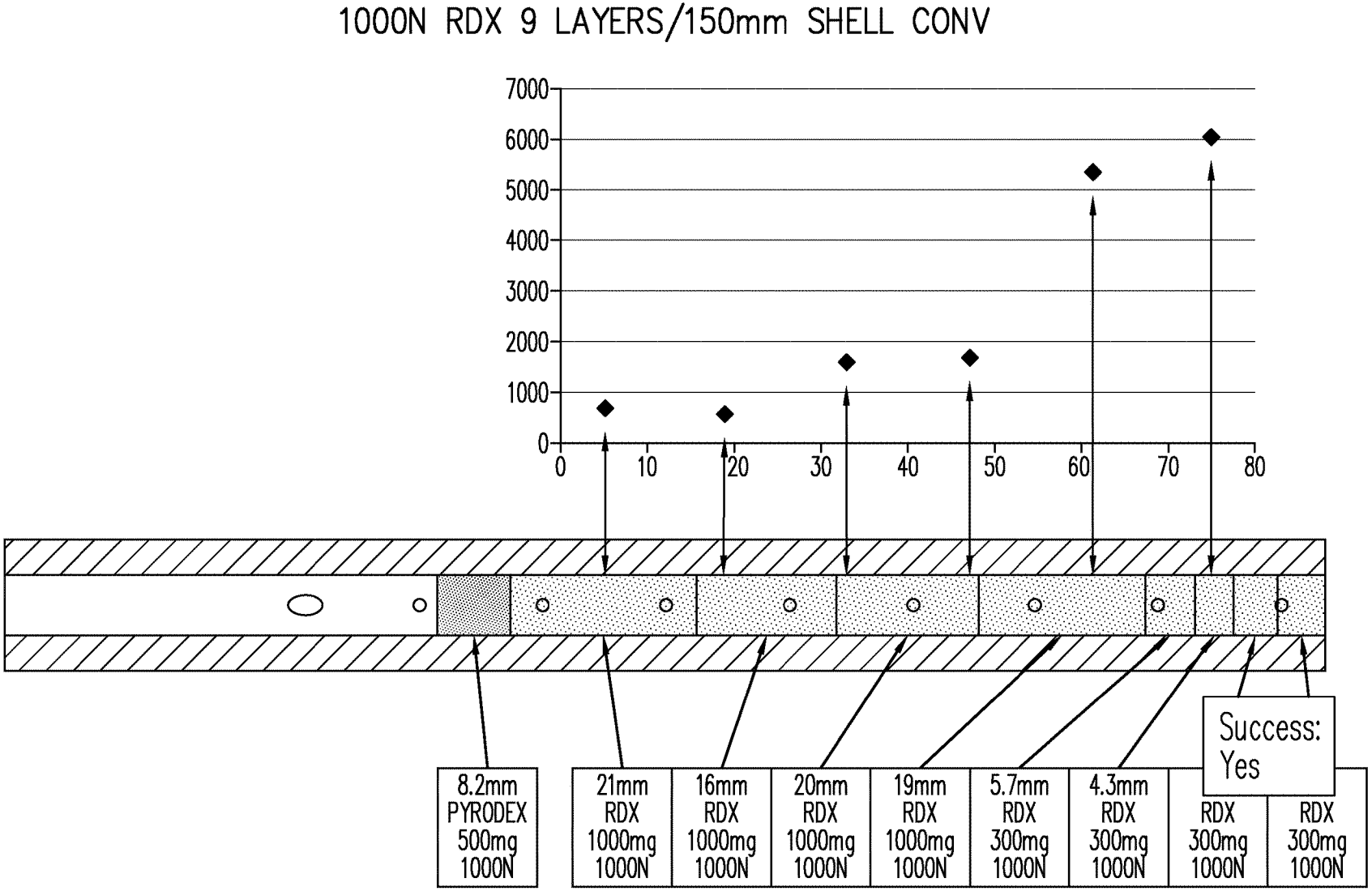
FIGS. 8-11 schematically illustrate in cross-section various detonator embodiments with different layers of pyrotechnical material and main explosive load, according to embodiments.

FIG. 8 illustrates an exemplary detonator having a single layer of pyrotechnical material 210, and a multilayered main explosive load 217 having 8 layers. For example, the pyrotechnical layer may include 500 mg of Pyrodex compressed to 8.2 mm by 1000N. The first layer 215*a* of the main explosive load may include 1000 mg of RDX compressed by 1000N to 21 mm. The second layer 215*b* of the main explosive may include 1000 mg of RDX compresses by 1000N to 16 mm. The third layer 215*c* may include 1000 mg of RDX compressed by 1000N to 20 mm. The fourth layer 215*d* may include 1000 mg of RDX compressed to 19 mm by 1000N. The fifth layer may include 300 mg of RDX compressed to 5.7 mm by 1000N. The sixth layer may include 300 mg of RDX compressed to 4.3 mm by 1000N.

Figure 9:
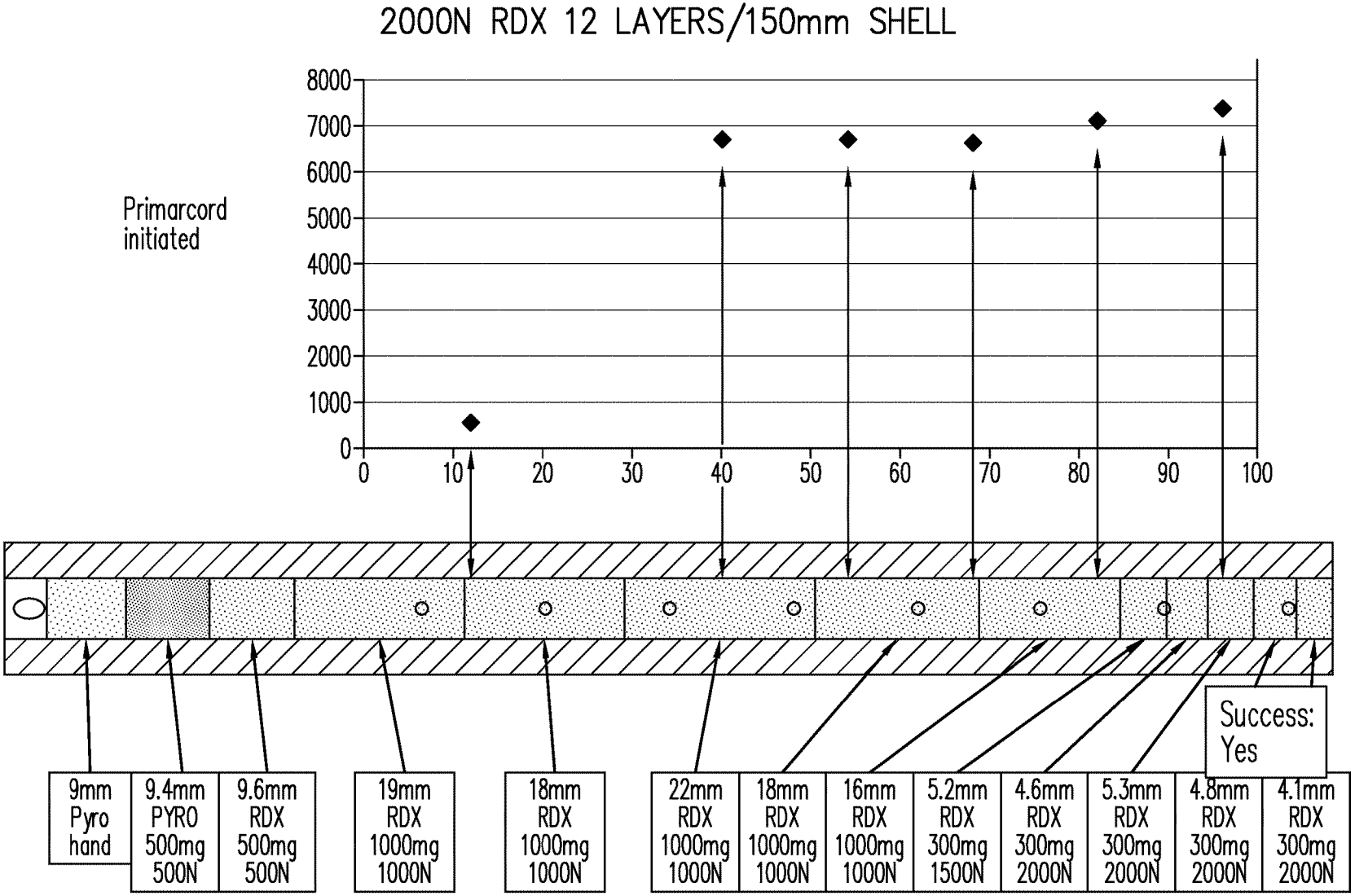

FIG. 9 illustrates an exemplary detonator having a multilayered pyrotechnical material 212 with two pyrotechnical layers, and a multilayered main explosive load 217 having 11 layers. For example, the first pyrotechnical layer may include Pyrodex hand loaded to a thickness of 9 mm, and the second pyrotechnical layer may include 500 mg of Pyrodex compressed to 9.4 mm thickness by 500N. The first layer 215*a* of the main explosive load may include 500 mg of RDX compressed to 9.6 mm thickness by 500N; the second layer 215*b* may include 1000 mg of RDX compressed to 19 mm thickness by 1000N; the third layer 215*c* may include 1000 mg of RDX compressed to 18 mm by 1000N; the fourth layer 215*d* may include 1000 mg of RDX compressed to 22 mm by 1000N; the fifth layer includes 1000 mg of RDX compressed to 18 mm by 1000N; the sixth layer includes 1000 mg of RDX compressed to 16 mm by 1000N; the seventh layer includes 300 mg of RDX compressed to 5.2 mm by 1500N; the eighth layer includes 300 mg of RDX compressed to 4.6 mm by 2000N; the ninth layer includes 300 mg of RDX compressed to 5.3 mm by 2000N; the tenth layer includes 300 mg of RDX compressed to 4.8 mm by 2000N; and the eleventh layer includes 300 mg of RDX compressed to 4.1 mm by 2000N.

Figure 10:
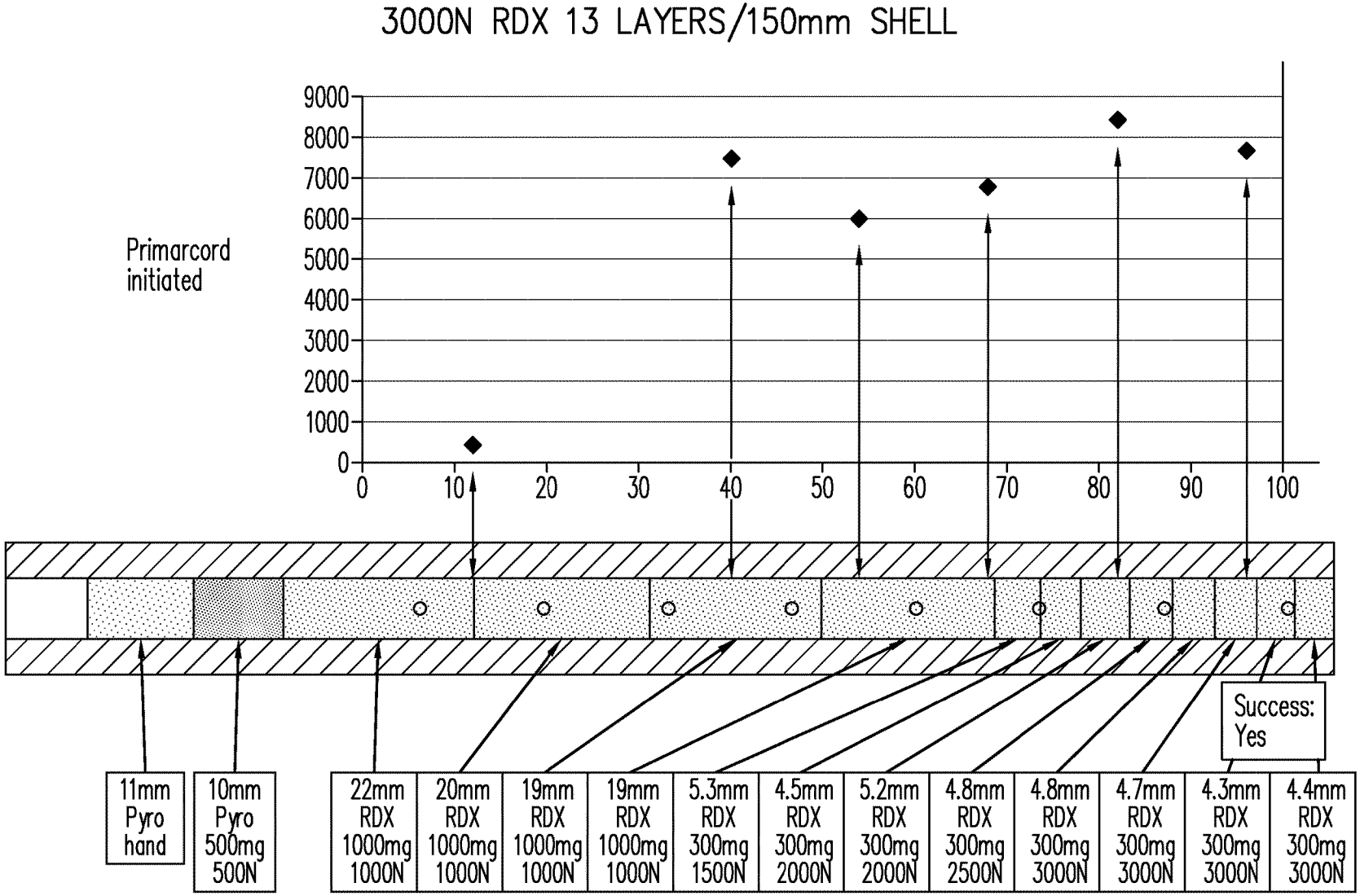

FIG. 10 illustrates an exemplary detonator having a multilayered pyrotechnical material 212 with two layers, and a multilayered main explosive load 217 having 12 layers. For example, the first pyrotechnical layer may include 11 mm of Pyrodex hand loaded, and the second pyrotechnical layer may include 500 mg of Pyrodex compressed to a thickness of 10 mm by 500N. The first layer 215*a* of the main explosive load may include 1000 mg of RDX compressed to thickness of 22 mm by 1000N; the second layer 215*b* may include 1000 mg of RDX compressed to 20 mm by 1000N; the third layer 215*c* may include 1000 mg of RDX compressed to 19 mm by 1000N; the fourth layer 215*d* may include 1000 mg of RDX compressed to 19 mm by 1000N; the fifth layer includes 300 mg of RDX compressed to 5.3 mm by 1500N; the sixth layer includes 300 mg of RDX compressed to 4.5 mm by 2000N; the seventh layer includes 300 mg of RDX compressed to 5.2 mm by 2000N; the eighth layer includes 300 mg of RDX compressed to 4.8 mm by 2500N; the ninth layer includes 300 mg of RDX compressed to 4.8 mm by 3000N; the tenth layer includes 300 mg of RDX compressed to 4.7 mm by 3000N; the eleventh layer includes 300 mg of RDX compressed to 4.3 mm by 3000N; and the twelfth layer includes 300 mg of RDX compressed to 4.4 mm by 3000N.

Figure 11:
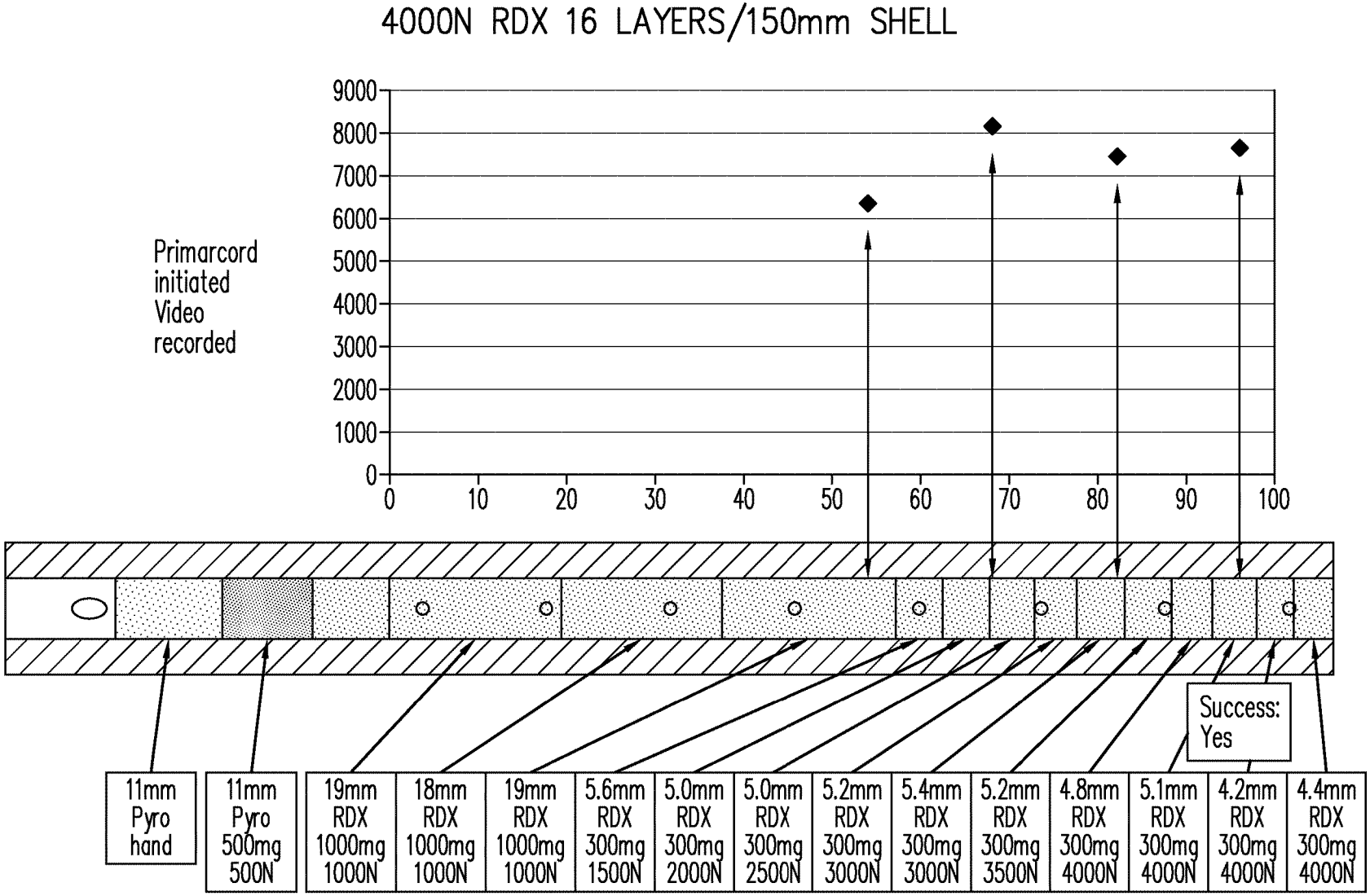

FIG. 11 illustrates an exemplary detonator having a multilayered pyrotechnical material 212 with two layers, and a multilayered main explosive load 217 having 13 layers. For example, the first pyrotechnical layer may include 11 mm of Pyrodex hand loaded, and the second pyrotechnical layer may include 500 mg of Pyrodex compressed to a thickness of 11 mm by 500N. The first layer 215*a* of the main explosive load may include 1000 mg of RDX compressed to thickness of 19 mm by 1000N; the second layer 215*b* may include 100 mg of RDX compressed to 18 mm by 1000N; the third layer 215*c* may include 1000 mg of RDX compressed to 19 mm by 1000N; the fourth layer 215*d* may include 300 mg of RDX compressed to 5.6 mm by 1500N; the fifth layer includes 300 mg of RDX compressed to 5.0 mm by 2000N; the sixth layer includes 300 mg of RDX compressed to 5.0 mm by 2500N; the seventh layer includes 300 mg RDX compressed to 5.2 mm by 3000N; the eighth layer includes 300 mg RDX compressed to 5.4 mm by 3000N; the ninth layer includes 300 mg RDX compressed to 5.2 mm by 3500N; the tenth layer includes 300 mg RDX compressed to 4.8 mm by 4000N; the eleventh layer includes 300 mg RDX compressed to 5.1 mm by 4000N; the twelfth layer includes 300 mg RDX compressed to 4.2 mm by 4000N; and the thirteenth layer includes 300 mg RDX compressed to 4.4 mm by 4000N.

In some embodiments, the pattern of density increase may not be a constant increase, for example having some layers where density remains approximately steady or even decreases slightly, but typically the overall pattern of density increase may hold. For example, the density of the first layer 215*a* (e.g. the layer closest to the pyrotechnical material 210) would typically be less than the density of the last layer of main explosive load (e.g. the layer disposed closest to the closed and/or furthest from the pyrotechnical material 210).

Figure 6A:
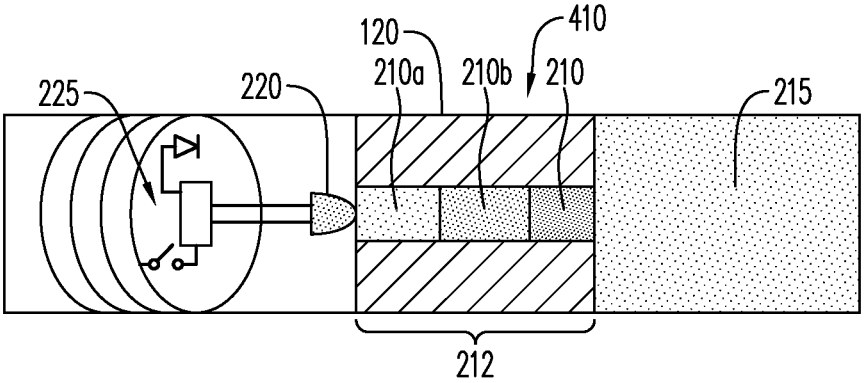
FIGS. 6A-6C are schematic cross-section figures which illustrate various detonator shell designs of a detonator, according to an embodiment.
Figure 6B:
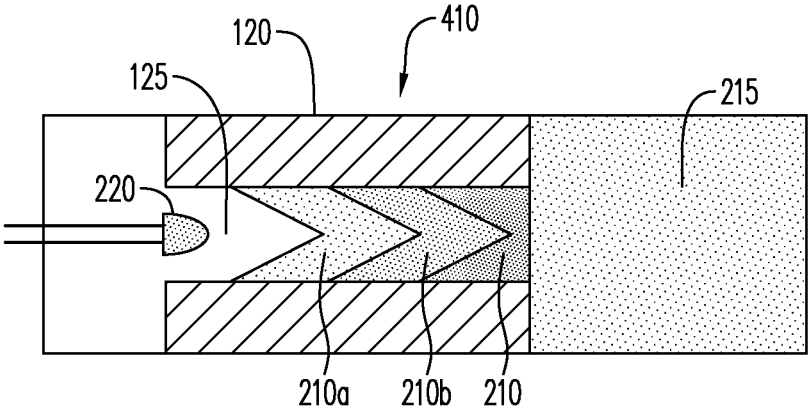
Figure 6C:
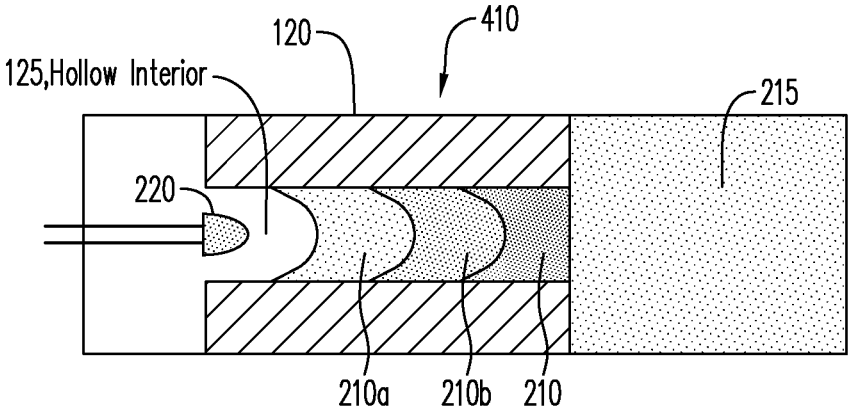
Figure 14A:
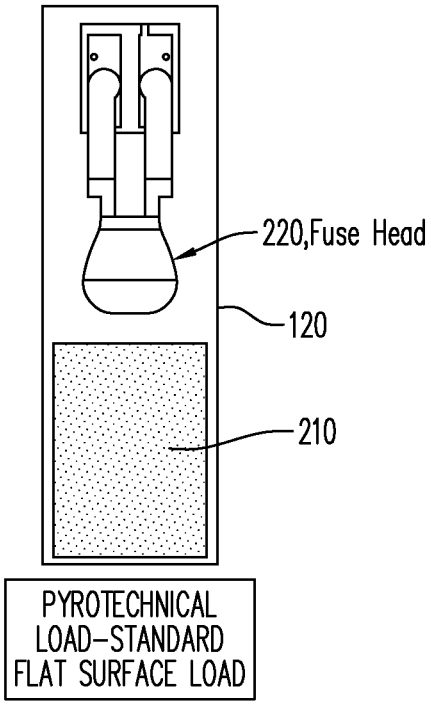
FIG. 14A schematically illustrates in cross-section a detonator including a pyrotechnical material with a flat surface area, according to an aspect.
Figure 14B:
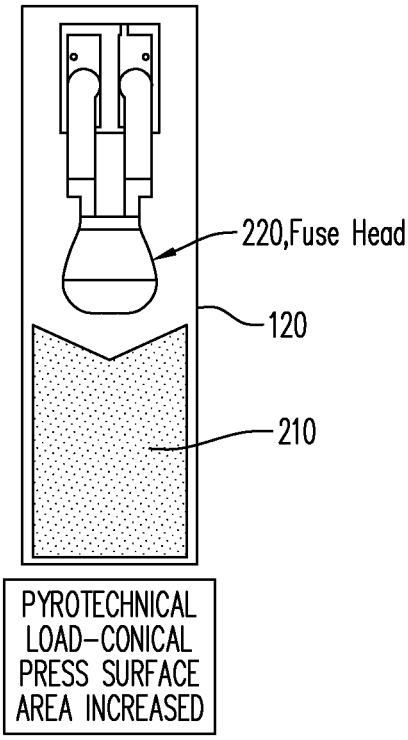
FIGS. 14B-14D each schematically illustrate in cross-section a detonator including a pyrotechnical material having increased surface areas (compared to the flat surface area of FIG. 14A), according to an aspect.
Figure 14C:
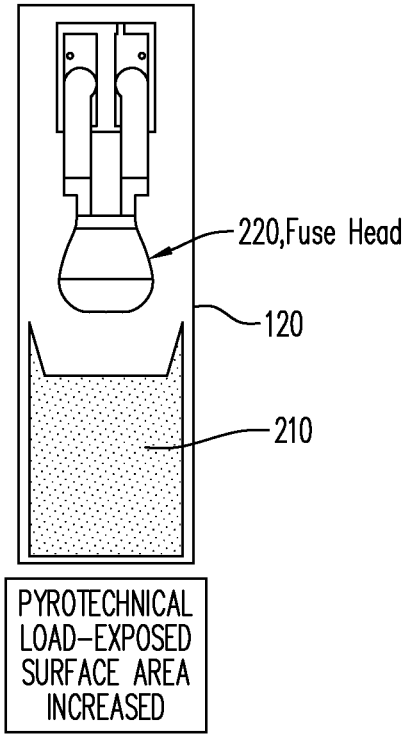
Figure 14D:
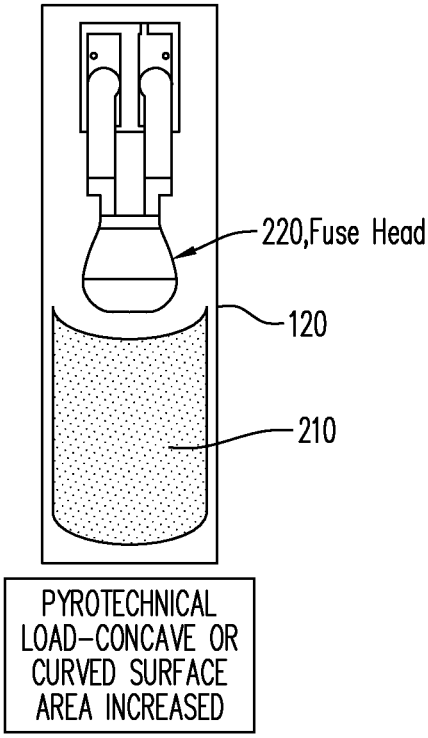

FIG. 6A illustrates a detonator 110 having a printed circuit board 225 (PCB) which can be stacked. The fuse head 220 of the detonator 110 extends over the pyrotechnical material 210, which has a substantially flat surface in this embodiment. In some embodiments, the pyrotechnical material 210 may be configured (e.g. shaped) to increase surface area exposure to the fuse head 220 via geometry (e.g. greater exposure than a flat layer, by being shaped to expose more of the pyrotechnical material 210 to the fuse head 220). FIG. 6B and FIG. 6C each illustrate a detonator 110 having a pyrotechnical material 210 having an increased surface area of exposure to the fuse head 220 (see also, FIGS. 14B-14D). For example, the pyrotechnical material 210 (or each layer of a multilayered pyrotechnical material 212) may be pressed into shape comprising one of a substantially V shape, a convex shaped contour, and a concave shaped contour (see for example FIGS. 6B-C). In some embodiments, the pyrotechnical material 210 may be shaped to at least partially encompass the fuse head 220.

Figure 12:
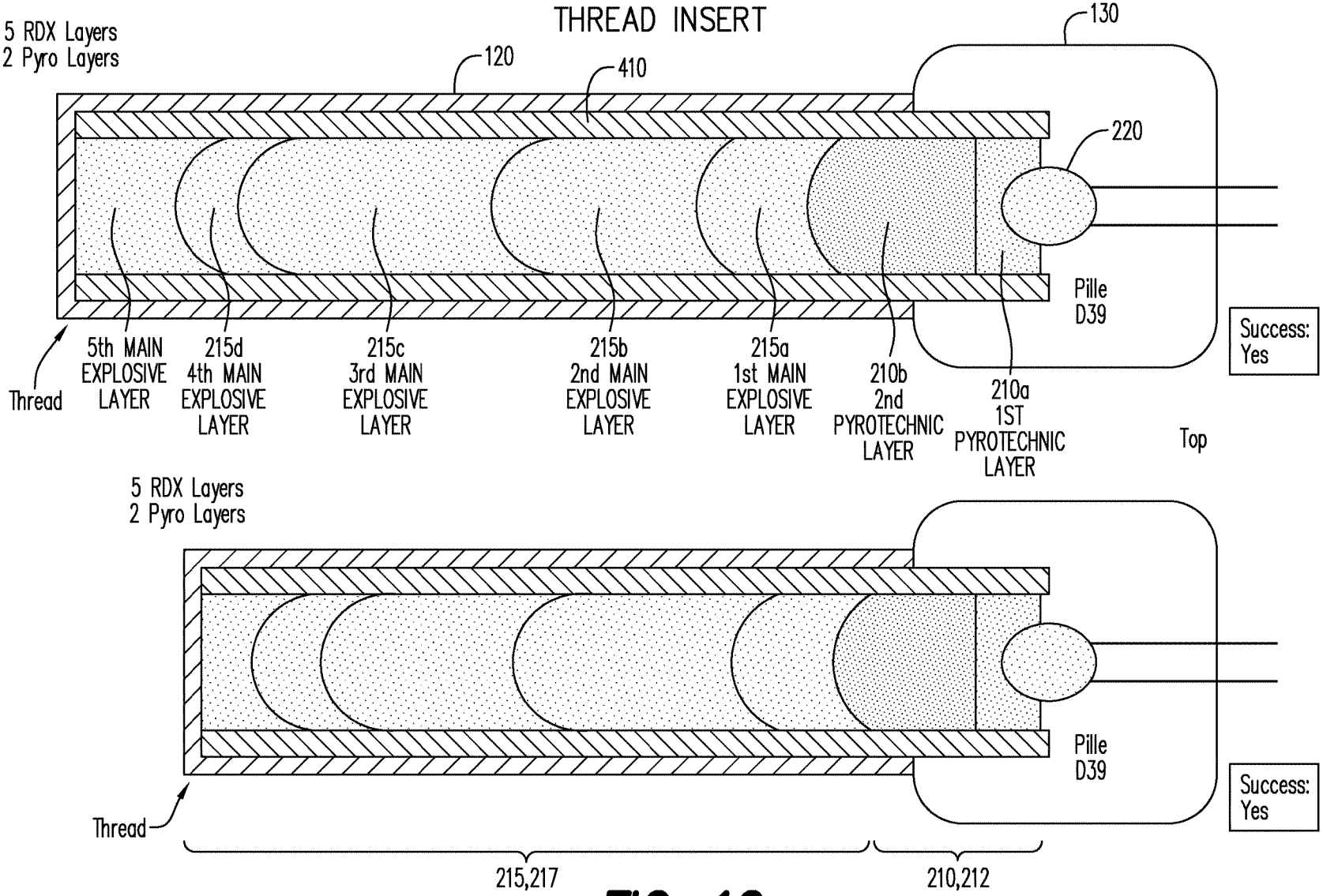
FIG. 12 schematically illustrates via cross-section a detonator including a threaded insert, according to an embodiment.

Similarly, in some embodiments, each layer of the multilayered main explosive load 217 may be pressed into shape comprising one of a substantially V shape, a convex shaped contour and a concave shaped contour. For example, the pressed shape may aid in stimulation of an acceleration of a gas burn rate within the detonation shell 120. In some embodiments, the shape of the main explosive load 215 may match the shape of the pyrotechnical material 210 (or at least the layer of pyrotechnical material 210 in proximity to (e.g. contacting) the main explosive load 215. See, for example FIG. 12.

Figure 13:
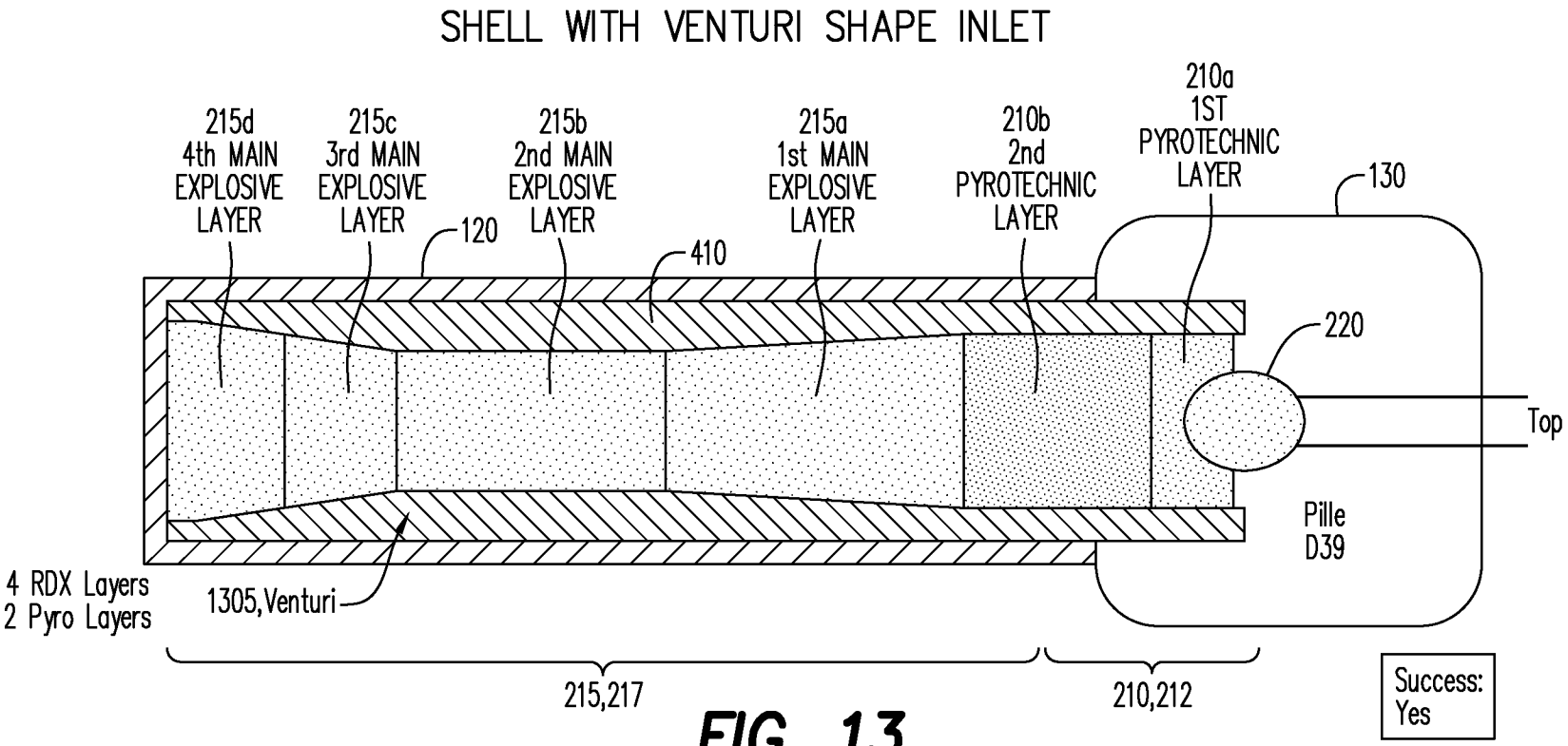
FIG. 13 schematically illustrates via cross-section a detonator including a venturi-shaped detonator shell interior and/or reinforcement area, according to an embodiment.

FIG. 13 illustrates an embodiment in which the reinforcement area 410 includes a venturi-shaped passageway 1305 (e.g. wasp-waisted or having a contracted portion, for example located away from either end). In some embodiments, the venturi-shaped passageway 1305 may be configured to confine the gas pressure in order to achieve a detonation.

Figure 7A:
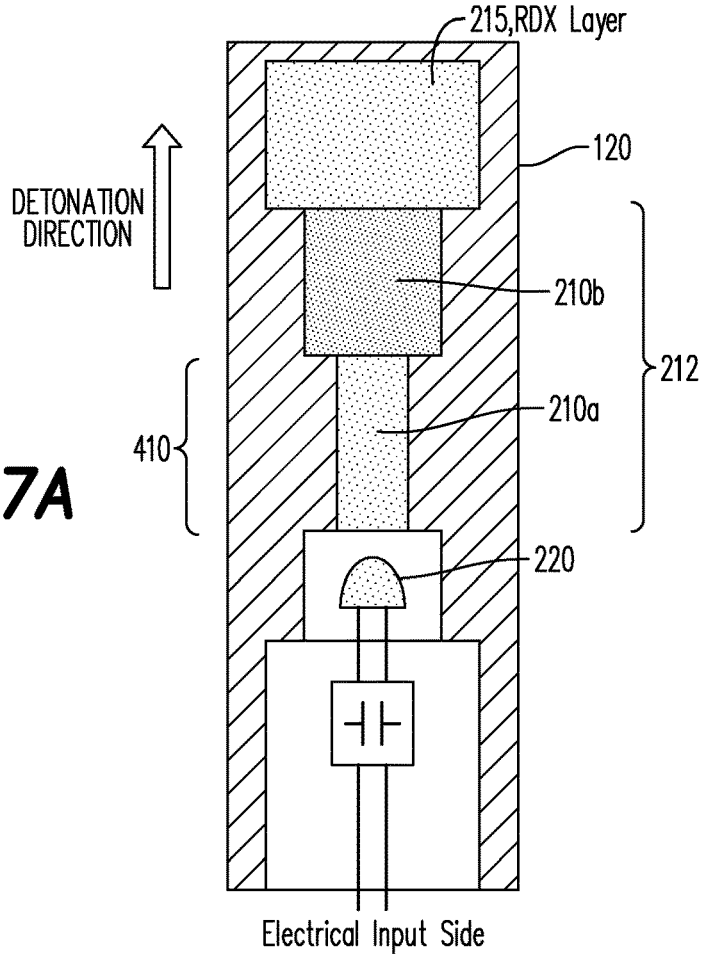
FIG. 7A is a cross-sectional view of a detonator shell of a detonator, according to an embodiment.
Figure 7B:
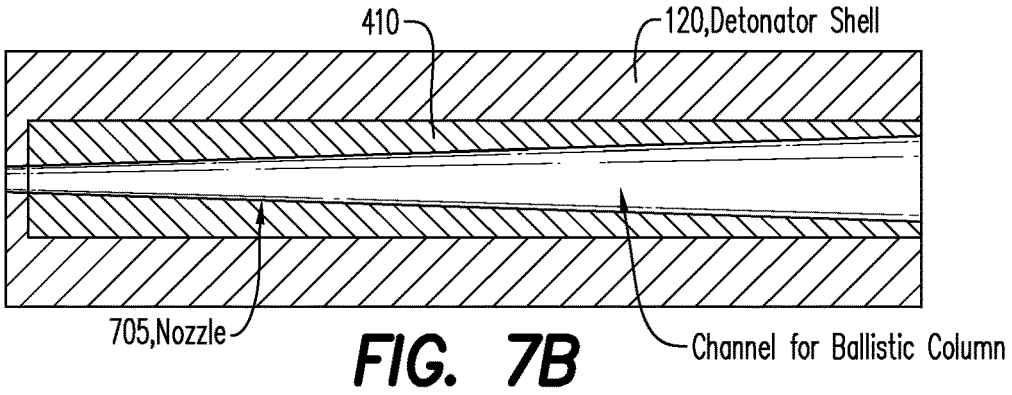
FIGS. 7B-7C schematically illustrate in cross-section various detonator shell designs of a detonator, according to an embodiment.
Figure 7C:
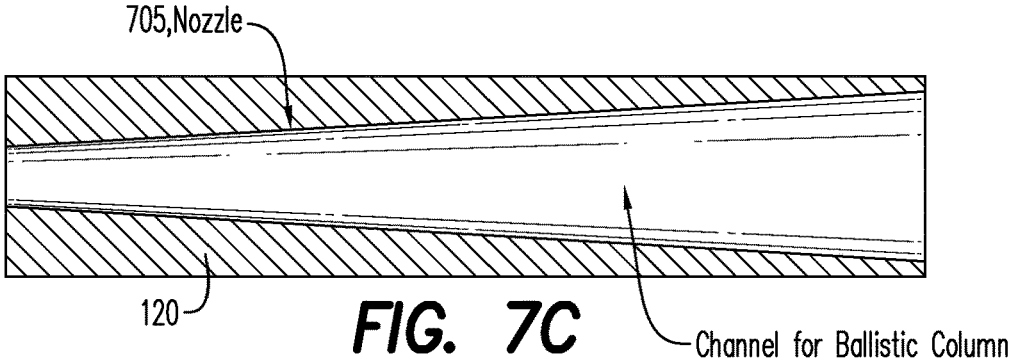

FIG. 7A is another illustration of a detonator shell 120 having a reinforcement area 410. In FIG. 7A, the reinforcement area 410 may vary along its length, for example providing more reinforcement to certain layers than to others. In some embodiments, the reinforcement area 410 may include a nozzle 705 having a larger inner diameter in proximity to the open end 122 and a smaller inner diameter in proximity to the closed end 124. For example, FIGS. 7B-C each illustrate an exemplary nozzle 705 having a continuous shape. In FIG. 7B, a nozzle 705 serving to form the reinforcement area 410 may be disposed within the detonator shell 120. In FIG. 7C, the nozzle 705 is formed as a portion of (e.g. integral to) the detonator shell 120.

The nozzle geometry may support the compressing of the different layers of explosive during the production process. With a straight or cylindrical column, explosive material tends to be pushed out of the tube during pressing. In addition, the nozzle geometry may prevent the explosives from being prematurely displaced by the gas pressure of the pyrotechnical material, which could have a negative effect on the DDT. By preventing a premature physical displacement of the explosive load, the geometry of the nozzle 705 can be conducive to the deflagration to detonation process.

In some embodiments, at least a portion (e.g. all) of the pyrotechnical material 210 may be disposed within the nozzle 705 or venturi-shaped passageway 1305. In some embodiments, at least a portion (e.g. all) of the main explosive load 215 may be disposed within the nozzle 705 or venturi-shaped passageway 1305. In other embodiments, none of the main explosive load 215 may be located within the nozzle 705 or venturi-shaped passage.

In some embodiments, for example as shown in FIGS. 5A-D, 6A, 7A, 9-13, the pyrotechnical material 210 may include a multilayered pyrotechnical material 212 (e.g. at least two layers of pyrotechnical material 210). For example, the multilayered pyrotechnical material 212 may include approximately or substantially the same material throughout, with variations in density. In some embodiments, the multilayered pyrotechnical material 212 may be configured so that a lowest density pyrotechnical layer is disposed in proximity to the open end 122 or fuse head 220, and each subsequent pyrotechnical layer extending away from the open end 122/fuse head 220 (and towards the closed end 124 or main explosive load 215) includes a higher pressed density. For example, the multilayered pyrotechnical material 212 may include a density gradient configured to accelerate deflagration, with the pyrotechnical layer in proximity to the open end 122/fuse head 220 having the lowest density of the multilayered pyrotechnical material 212, and the pyrotechnical layer closest to the closed end 124 (e.g. furthest from the fuse head 220/open end 122) having the highest density. Some embodiments of the multilayered pyrotechnical material 212 may have slight variations in the density gradient, such as adjacent subsequent layers having the same or slightly lower density, which may also be acceptable in some embodiments. In some embodiments, the density gradient may be configured so that the general trend of the density gradient (for example, if the density of the pyrotechnical layers is plotted on a graph and a line approximation of the trend is applied to the graph) is from lower to higher density. In some embodiments, the density of the pyrotechnical layers of the multilayered pyrotechnical material 212 may be configured based on press force, the amount of material per pyrotechnical layer, and/or the amount of compression (e.g. the thickness each pyrotechnical layer is compressed to by the press load).

In some embodiments, the multilayered pyrotechnical material 212 may have no more than 2 layers of pyrotechnical material 210 (e.g. the multilayered pyrotechnical material 212 may consist essentially of or include only two layers of pyrotechnical material 210). For example, the multilayered pyrotechnical material 212 may include a first pyrotechnical layer 210*a* comprising a first pyrotechnical pressed density, and a second pyrotechnical layer 210*b* comprising a second pyrotechnical pressed density. The first pyrotechnical pressed density may differ from the second pyrotechnical pressed density. For example, the second pyrotechnical pressed density may be greater than the first pyrotechnical pressed density. In some embodiments, the first pyrotechnical pressed density of the first pyrotechnical layer 210*a* may be 1.0 to 1.3 g/cm3, and the second pyrotechnical pressed density of the second pyrotechnical layer 210*b* may be 1.4 to 1.8 g/cm3. In some embodiments, the first pyrotechnical layer 210*a* is disposed adjacent to the open end 122 (or fuse head 220), and the second pyrotechnical layer 210*b* is disposed between the first pyrotechnical layer 210*a* and the main explosive load 215. Typically, the first pyrotechnical layer 210*a* and the second pyrotechnical layer 210*b* may be contacting (e.g. pressed into contact). Typically, the pyrotechnical layer 210 and the main explosive load 215 may be contacting (e.g. with the second pyrotechnical layer 210*b* contacting the first layer 215*a* of the main explosive load 215).

Although embodiments discussed in FIGS. 2-4 and 8-13 include a multilayered main explosive load 217 (which may be used with a single layer of pyrotechnical material 210 or with a multilayered pyrotechnical material 212), some embodiments (such as shown in FIGS. 5A-7A) may have only a single layer of main explosive load 215 used with multiple layers of pyrotechnical material 210.

Figure 15:
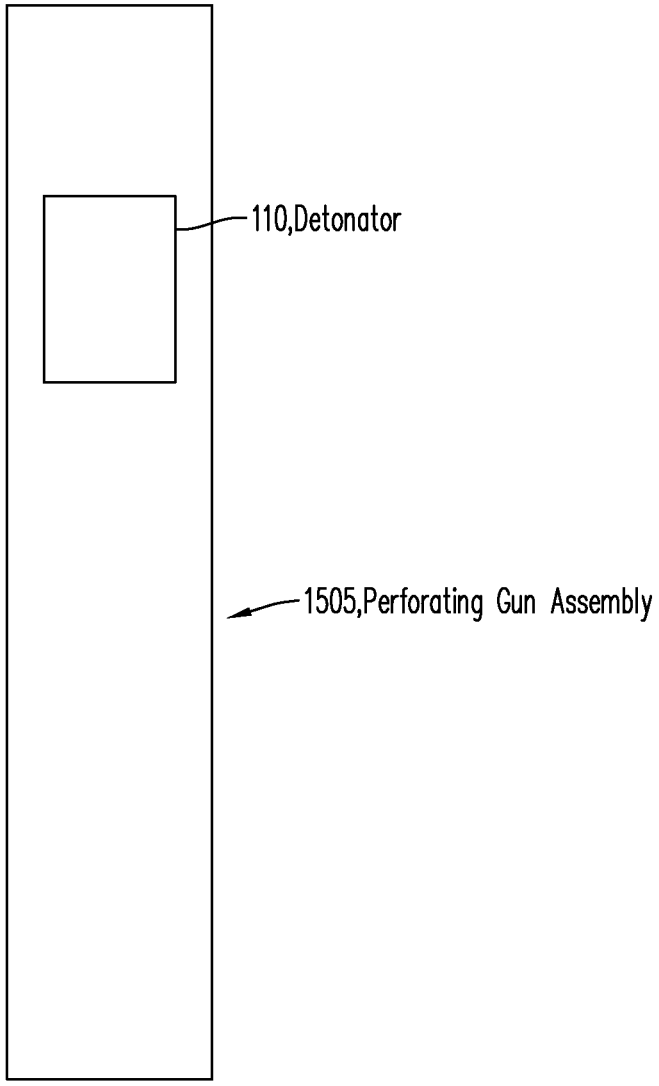
FIG. 15 is a schematic diagram showing an exemplary detonator in an exemplary perforating gun assembly, according to an embodiment.

In some embodiments, a perforating gun assembly 1505 may include the detonator 110, such as a low-voltage, non-primary explosive detonator 110 as described herein. FIG. 15 illustrates schematically the detonator 110 within the perforating gun assembly 1505. Additional elements of the perforating gun assembly, as discussed herein, may also be included in some embodiments.

Disclosed embodiments further include methods of manufacturing a low-voltage, primary-free detonator, similar to the examples described herein. For example, a detonator may be manufactured by steps comprising: forming a multilayered main explosive load 217 with at least two layers, wherein the density of the first layer differs from (e.g. is less than) the density of the second layer; and disposing the main explosive load and a pyrotechnical material in a detonator shell. In some embodiments, the main explosive load may be disposed between a closed end of the detonator shell and the pyrotechnical material, and the first layer of the main explosive load may be disposed in proximity to the pyrotechnical material (e.g. with the first layer of the main explosive load disposed between the second layer and the pyrotechnical material).

In some embodiments, the method may further include the step of providing or forming the detonator shell with a reinforcement area. In some embodiments, the reinforcement area may be configured as a nozzle. In some embodiments, the reinforcement area may be configured as a venturi-shaped passageway. In some embodiments, the pyrotechnical material may be disposed within the reinforcement area.

In some embodiments, the multilayered main explosive load 217 may be formed by pressing layers atop one another to achieve desired layer density gradient. According to an aspect, a first layer of the main explosive load may be pressed at a relatively low density, and one or more subsequent layers of the main explosive load may be pressed (e.g. at a higher pressing force) on top of the first layer of the main explosive load to induce an increase press-density main explosive load and/or a main explosive load having a density gradient configured to accelerate deflagration. In some embodiments, the materials may be pressed from bottom (e.g. highest density) to top (e.g. lowest density), for example pressing the layer in proximity to the closed end of the detonator shell first. The propagation of the main explosive load, from layer to layer, may induce an increase of acceleration in the burn speed or gas combustion velocity. In other words, the deflagration can turn into a high-speed detonation in a very short space within the confined detonator shell.

The pyrotechnical material (such as black powder or Pyrodex) may be disposed atop the main explosive load. It is contemplated that the pyrotechnical material may include one or more pyrotechnical layers, such as a first pyrotechnical layer pressed at a low density, and a second pyrotechnical layer disposed adjacent the first pyrotechnical layer and pressed at a higher pressing force than the first pyrotechnical layer. Thus, the first of the pyrotechnical layers may have a pressed density less than a pressed density of the second of the pyrotechnical layers, and the second pyrotechnical layer may be disposed between the first pyrotechnical layer and the main explosive load. This type of density gradient may also induce the increase or acceleration in the burn-speed or gas combustion velocity. In some embodiments, the pyrotechnical material and/or the main explosive load may be shaped, for example to increase surface area exposed to a fuse head.

In some embodiments, the pyrotechnical material can be initiated using a conventional detonator fuse-head that does not require a high voltage impulse or a large current (<800 mA) to initiate. According to an aspect, the primary-free detonator can be electrically initiated just like a conventional 50 Ohm resistorized oilfield detonator. Alternatively, the detonator assembly can also be combined with an internal electronic circuitry by which the fuse head is initiated using an RF-Safe, i.e., radio frequency safe, digital code sequence through the circuit board. The fuse head and electronic circuit board used with the detonator assembly described herein do not require a high voltage to initiate the pyrotechnical material. The RF-Safe digital code sequence (digital pulse) will operate with less than 30 volts power supply. In some embodiments, the digital pulse signal sequence will charge a capacitor within the detonator, which then discharges onto the fuse-head with the detonator.

The layered arrangement of the main explosive load and/or the pyrotechnical material (with one or more layers) facilitates a delay time of less than 5 milliseconds (i.e., the time to go from a deflagration or burn to a high-speed detonation). According to an aspect, the delay time may be less than 1 millisecond from the time a fuse head fires to the time the main explosive load has reached a detonation. It is further contemplated that the reliability and effectiveness of the transfer between the fuse-head and the pyrotechnical load in the contemplated detonator may depend on both a sufficiently strong and sudden energetic output (steep or abrupt pressure and a high pressure peak) from the fuse head, as well as the geometry and make-up of the main pyrotechnical load and grain structure.

According to an aspect, the initiation sensitivity from the fuse head to the pyrotechnical load or material increases the effectiveness of the transition from a burn or deflagration to a highspeed detonation by increasing the surface area exposed to the fuse-head flame. The total surface area of the pyrotechnical grain exposed to the ignition from the fuse head can be enhanced by the geometry design of the pressed surface area of the pyrotechnical material.

The fuse head inside the detonator may be a small structure that is configured to convert electrical energy into pyrotechnical energy. Fuse heads typically include a fine structured bridge wire or filament wire. The bridge wire may include a coating of a reactive high-energy pyrotechnic composition. According to an aspect, the bridge wire can be embedded inside the pyrotechnical composition that may be typically coated with a thin layer of polymer. The selected polymer, or whether a polymer is included at all, may depend on the temperature and mechanical and structural requirements of the fuse head and the detonator. When electric current flow through the filament wire or bridge wire (and exceeds an All-Fire current value), the filament bursts and provides a sudden output of energy or spark which immediately ignites the pyrotechnical layers in the fuse head.

In order to activate or initiate the contemplated detonator, the current flow can be measured to assess whether it has an All-Fire or a No-Fire current. The All-Fire Current is a defined current level where statistically 99.98% of the fuse-heads will initiate successfully when this current is met or exceeded in a specified time of period (milliseconds (ms)). The No-Fire Current is a defined current level where statistically 99.98% of the fuse-heads will NOT initiate when this current is not met or exceeded in a specified time period (milliseconds (ms)). Any electrical current levels in between the All Fire and No Fire would be a statistical "grey" zone. Such "grey" zones are avoided or ignored, because the "grey" zones may not be reliable, and the expected fuse-head behavior is undefined.

According to an aspect, the All-Fire current values for fuse heads used in the detonator may be between about 450 mA and about 1.2 A. The No Fire current values for fuse heads used in the detonator may be between about 150 mA and about 400 mA. In an embodiment, the output energy from the fuse head depends on the quantity (such as the size and amount) and the type of the pyrotechnical initiation composition. For example, the mass by weight of the fuse head initiation composition in which the bridge-wire is embedded may be about 65 milligrams. According to an aspect, the mass by weight of the fuse head initiation composition can be about 50 mg to about 65 mg. The fuse head of the detonator may generate a pressure pulse output of up to about 40 bars. According to an aspect, the pressure pulse output from the electrical fuse head may be between about 20 bars and 40 bars. It is contemplated that the output level of the fuse head may recede with increasing temperature exposure and duration.

This disclosure, in various embodiments, configurations and aspects, includes components, methods, processes, systems, and/or apparatuses as depicted and described herein, including various embodiments, sub-combinations, and subsets thereof. This disclosure contemplates, in various embodiments, configurations and aspects, the actual or optional use or inclusion of, e.g., components or processes as may be well-known or understood in the art and consistent with this disclosure though not depicted and/or described herein.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that the appended claims should cover variations in the ranges except where this disclosure makes clear the use of a particular range in certain embodiments.

The terms "determine", "calculate" and "compute," and variations thereof, as used herein, are used interchangeably and include any type of methodology, process, mathematical operation or technique.

This disclosure is presented for purposes of illustration and description. This disclosure is not limited to the form or forms disclosed herein. In the Detailed Description of this disclosure, for example, various features of some exemplary embodiments are grouped together to representatively describe those and other contemplated embodiments, configurations, and aspects, to the extent that including in this disclosure a description of every potential embodiment, variant, and combination of features is not feasible. Thus, the features of the disclosed embodiments, configurations, and aspects may be combined in alternate embodiments, configurations, and aspects not expressly discussed above. For example, the features recited in the following claims lie in less than all features of a single disclosed embodiment, configuration, or aspect. Thus, the following claims are hereby incorporated into this Detailed Description, with each claim standing on its own as a separate embodiment of this disclosure.

Advances in science and technology may provide variations that are not necessarily express in the terminology of this disclosure although the claims would not necessarily exclude these variations.

What is claimed is:

1. A detonator, comprising:

a detonator shell having an open end, a closed end, and a hollow interior extending between the open end and the closed end;

a reinforcement area extending along at least a portion of the hollow interior;

a pyrotechnical material at least partially disposed within the reinforcement area; and a multilayered main explosive load disposed within the hollow interior of the detonator shell between the pyrotechnical material and the closed end;

wherein the reinforcement area comprises a venturi-shaped passageway.

2. The detonator of claim 1, wherein the detonator does not comprise any primary explosive.

3. The detonator of claim 1, further comprising:

a fuse head disposed in proximity to the open end of the detonator shell and at least partially extending into the hollow interior.

4. The detonator of claim 1, wherein the detonator shell comprises at least one of:

an outer diameter of 8 mm to 20 mm;

an inner diameter of at least 7 mm;

a wall thickness of at least 4.5 mm; and a length of up to 70 mm.

5. The detonator of claim 1, wherein the reinforcement area comprises:

a thicker portion of the detonator shell, with a thickness of at least 4.5 mm.

6. The detonator of claim 1, wherein the pyrotechnical material comprises:

black powder or Pyrodex.

7. The detonator of claim 6, wherein the main explosive load comprises cyclotrimethylenetrinitramine explosive.

8. The detonator of claim 1, wherein the multilayered main explosive load comprises:

a first layer comprising a first pressed density; and a second layer comprising a second pressed density, wherein the first pressed density differs from the second pressed density.

9. The detonator of claim 8, wherein:

the first layer is disposed adjacent to the pyrotechnical material; and the second layer is disposed between the first layer and the closed end.

10. The detonator of claim 9, wherein the second pressed density is greater than the first pressed density.

11. The detonator of claim 1, wherein:

the multilayered main explosive load is configured so that a lowest density layer is disposed in proximity to the pyrotechnical material; and each subsequent layer extending away from the pyrotechnical material comprises a higher pressed density.

12. The detonator of claim 1, wherein the reinforcement area comprises one or more ribs or projections circumferentially extending around the inner surface of the detonator shell.

13. The detonator of claim 1, wherein the reinforcement area comprises a nozzle having a larger inner diameter in proximity to the open end and a smaller inner diameter in proximity to the closed end.

14. The detonator of claim 1, wherein:

each layer of the multilayered main explosive load is pressed into a shape comprising one of a substantially V shape, a convex shaped contour and a concave shaped contour, wherein the pressed shape aids in stimulation of an acceleration of a gas burn rate within the detonation shell;

the pyrotechnical material is pressed into a shape comprising one of a substantially V shape, a convex shaped contour and a concave shaped contour; and the shape of the pyrotechnical material matches the shape of the main explosive load.

15. The detonator of claim 1, wherein:

the pyrotechnical material comprises a multilayered pyrotechnical material; and the multilayered pyrotechnical material comprises:

a first pyrotechnical layer comprising a first pyrotechnical pressed density; and a second pyrotechnical layer comprising a second pyrotechnical pressed density;

wherein the first pyrotechnical pressed density differs from the second pyrotechnical pressed density.

16. A low-voltage, primary-free detonator, comprising:

a ballistic vessel comprising a detonator shell comprising an open end, a closed end, a hollow interior extending between the open end and the closed end, and a deflagration to detonation transition (DDT) section extending along at least a portion of the hollow interior, wherein the DDT section comprises a reinforcement area extending from an inner surface of the detonator shell towards the hollow interior;

a pyrotechnical material disposed within the DDT section; and a multilayered main explosive load disposed within the hollow interior of the detonator shell between the pyrotechnical material and the closed end;

wherein the pyrotechnical material is a multilayered pyrotechnical material comprising two pyrotechnical layers, with each pyrotechnical layer having a different pyrotechnical pressed density, and wherein upon initiation of the detonator, the DDT section confines a burning gas within the hollow interior to linearly increase a burn speed of the pyrotechnical material until the burn speed reaches a detonation velocity of at least 6000 m/sec.

17. The detonator of claim 16, wherein the multilayered main explosive load comprises:

two or more layers of main explosive load and has a density gradient formed by orientation of the layers, with a lowest density layer disposed in proximity to the pyrotechnical material, and each successive layer of the multilayered main explosive load having a greater density than an adjacent previous layer.

18. A detonator, comprising:

a detonator shell having an open end, a closed end, and a hollow interior extending between the open end and the closed end;

a reinforcement area extending along at least a portion of the hollow interior;

a pyrotechnical material at least partially disposed within the reinforcement area; and a multilayered main explosive load disposed within the hollow interior of the detonator shell between the pyrotechnical material and the closed end;

wherein:

the pyrotechnical material comprises a multilayered pyrotechnical material;

the multilayered pyrotechnical material comprises:

a first pyrotechnical layer comprising a first pyrotechnical pressed density; and a second pyrotechnical layer comprising a second pyrotechnical pressed density; and the first pyrotechnical pressed density differs from the second pyrotechnical pressed density.

19. The detonator of claim 18, wherein the reinforcement area comprises one or more ribs or projections circumferentially extending around the inner surface of the detonator shell, or the reinforcement area comprises a nozzle having a larger inner diameter in proximity to the open end and a smaller inner diameter in proximity to the closed end.

20. The detonator of claim 18, wherein:

each layer of the multilayered main explosive load is pressed into a shape comprising one of a substantially V shape, a convex shaped contour and a concave shaped contour, wherein the pressed shape aids in stimulation of an acceleration of a gas burn rate within the detonation shell;

the pyrotechnical material is pressed into a shape comprising one of a substantially V shape, a convex shaped contour and a concave shaped contour; and the shape of the pyrotechnical material matches the shape of the main explosive load.

* * * * *